United States Patent [19]

Stark, Sr.

[11] Patent Number: 4,574,404

[45] Date of Patent: Mar. 11, 1986

[54] AIRLIFT BULKHEAD

[76] Inventor: Robert G. Stark, Sr., 735 NE. 198th St., Seattle, Wash. 98155

[21] Appl. No.: 581,919

[22] Filed: Feb. 21, 1984

[51] Int. Cl.[4] ..... E04H 3/18

[52] U.S. Cl. ..... 4/505; 4/496; 4/506; 4/495; 114/77 A; 114/78

[58] Field of Search ..... 114/78, 77 A; 4/496, 4/497, 505, 495, 506; 272/4; 405/74

[56] References Cited

U.S. PATENT DOCUMENTS

| | | | |
|---|---|---|---|
| 3,582,999 | 6/1911 | Baker | 4/505 |
| 3,734,113 | 5/1973 | Madden | 4/495 X |
| 3,760,432 | 9/1973 | Glorisi | 4/495 |
| 3,842,484 | 10/1974 | Stark | 4/497 X |
| 3,935,599 | 2/1976 | Stark | 4/505 |
| 4,229,843 | 10/1980 | Belanger | 4/495 |
| 4,271,542 | 6/1981 | Wood et al. | 4/495 |
| 4,292,696 | 10/1981 | Berger | 4/496 X |
| 4,464,080 | 8/1984 | Gorlov | 405/76 |

*Primary Examiner*—Henry K. Artis
*Attorney, Agent, or Firm*—Seed and Berry

[57] ABSTRACT

A movable, submersible, transversely extending bulkhead for use in a swimming pool. The bulkhead has an elongated hollow body with top, bottom, end and side walls and a pair of spaced air chambers positioned toward each of its ends. Positioned between and substantially equidistant from each of the air chambers is at least one core of buoyant material. The bulkhead also utilizes means for selectively controlling the quantity of air and water within the chambers for regulating the buoyancy of the bulkhead. The bulkhead may be moved along the length of a swimming pool through increasing the buoyancy of the bulkhead by displacing the water contained in the chambers, shifting the bulkhead to a new longitudinally spaced position within the pool, and decreasing the buoyancy of the bulkhead by allowing water to reenter the chambers.

14 Claims, 4 Drawing Figures

AIRLIFT BULKHEAD

DESCRIPTION

1. Technical Field

The present invention relates to swimming pool bulkheads in general, and, in particular, to a submersible swimming pool bulkhead which utilizes bouyancy chambers for movement, effectively eliminating the use of wheels for guidance and support of the bulkhead while in transit.

2. Background Art

Movable bulkheads for swimming pools have heretofore been constructed of a variety of materials, such as aluminum, stainless steel, or fiberglass, and have been equipped with wheels which can ride upon the channel or deck of a pool to provide the bulkhead with mobility. Conventional designs which employ wheels for movement have several problems associated with them; for example, damage to pool tiles through pressure applied to the tiles by the wheels, untracking of the wheels during transit, and the relatively large number of individuals required to move this type of bulkhead. Accordingly, it is the primary object of the present invention to provide an improved swimming pool bulkhead eliminating the need for wheels, and to further provide other related advantages.

Other objects and advantages of the invention will become apparent upon reading the following detailed description and upon reference to the attached drawings.

DISCLOSURE OF THE INVENTION

Briefly stated, the present invention consists of a movable, submersible, transversely extending bulkhead for use in a swimming pool, comprised of an elongated hollow body having top, bottom, end and side walls, at least one air chamber positioned towards each end of the body, and means for selectively controlling the quantity of air and water within the chambers.

In one embodiment of the invention, particular features of the bulkhead include a pair of spaced air chambers provided with a valve which communicates with the interior of the air chambers, a core of buoyant material positioned substantially between and equidistant from each of the air chambers, a pair of compartments positioned adjacent to the outwardly facing end of the air chambers, each of the compartments having an opening providing for the free ingress and egress of water into and out of the compartments, means for selectively controlling the quantity of air and water within the chambers, means for guiding the bulkhead while in transit, and means for securing the bulkhead in a stationary position.

In addition, the invention provides for a method of moving a transversely extending bulkhead which has at least one air chamber positioned towards each of its ends, along with means for selectively controlling the quantity of air and water within the chambers, which generally comprises the steps of increasing the buoyancy of the chambers by displacing the water contained therein, shifting the bulkhead to a new position within the pool, and subsequently decreasing the buoyancy of the chambers by allowing water to reenter the chambers.

BEST MODE FOR CARRYING OUT THE INVENTION

Figure 1:
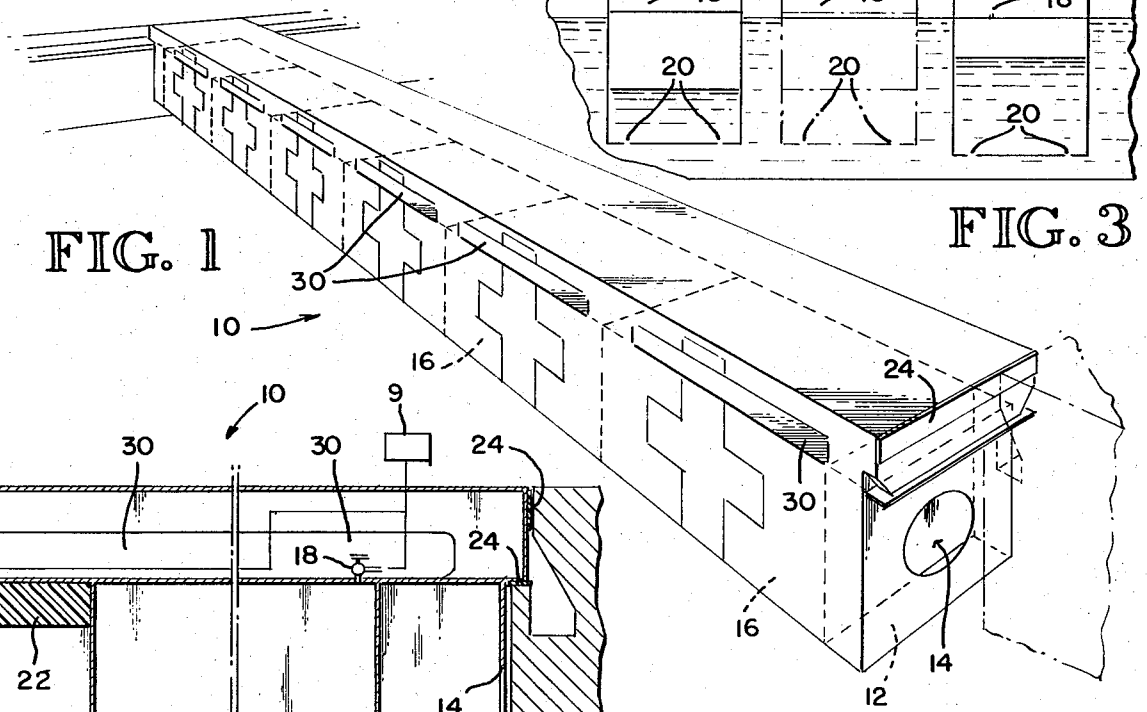
FIG. 1 is a perspective view of a bulkhead embodying the present invention.

In reference to FIG. 1, a movable, submersible bulkhead 10 is shown in its operative and stationary position. The bulkhead structure and skin should preferably be composed of fiberglass, with all other materials being plastic, stainless steel or similar noncorrosive material. The bulkhead 10 utilizes a pair of compartments 12 positioned on the outwardly facing ends formed by the top, bottom, side and end walls of bulkhead 10. Each of the compartments 12 has an opening 14 which provides for the free ingress and egress of water into and out of the compartment. These compartments add stability and balance to the bulkhead when it is in a submerged position.

Figure 2:
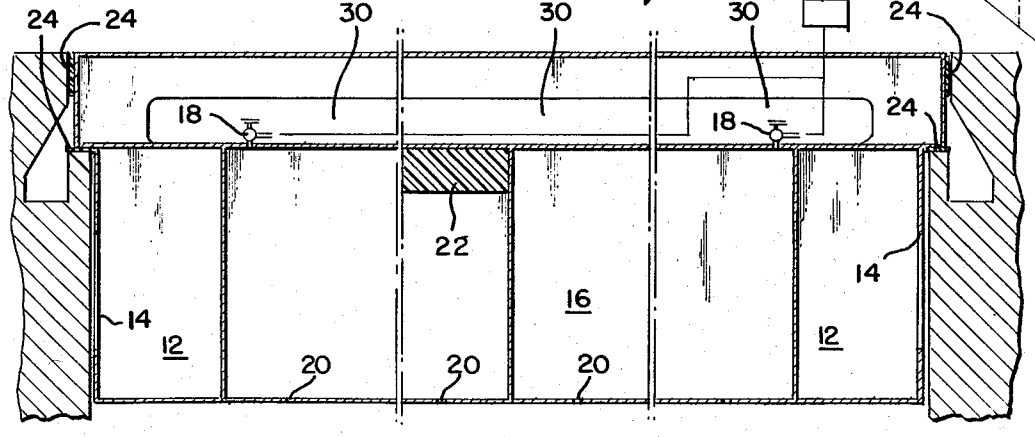
FIG. 2 is an enlarged fragmentary front elevational view of the bulkhead of FIG. 1.

Turning to FIG. 2, adjacent to the inwardly facing ends of compartments 12 are a pair of spaced air chambers 16. Each of the air chambers is fitted with a valve 18 which communicates with a source of gas 9 under pressure, and at least one aperture 20 which is in constant communication with the water in the pool. Positioned between and substantially equidistant from each of the air chambers is at least one core of buoyant material 22 which aids in providing the buoyancy necessary to render the bulkhead movable. This core may be formed of foam, entrapped air, or any other suitable buoyant material.

Figure 3:
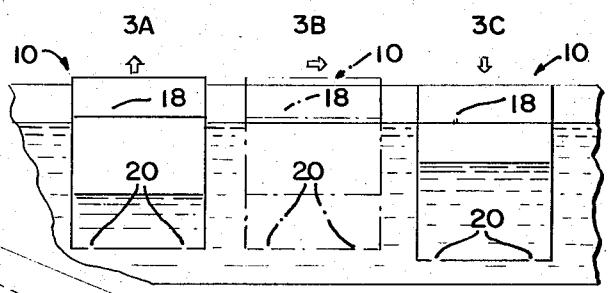
FIG. 3 is a sequence of views showing and illustrating the flotation, movement, and submersion of the bulkhead of FIG. 1.
Figure 4:
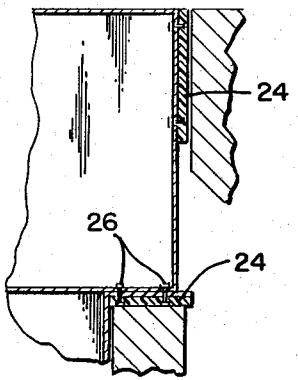
FIG. 4 is an enlarged fragmentary view of a portion of FIG. 2.

As shown in FIGS. 2, 3 and 4, the ends of the bulkhead may also be provided with a set of plastic bumper strips 24 which act as a means for guiding the bulkhead while in transit, as well as protecting both the bulkhead and the pool from damage due to frictional contact therebetween. The bulkhead may be further held securely in place through the use of noncorrosive locking devices or pins 26, as shown in FIG. 4.

Referring now to FIG. 3, when it is necessary to shift the bulkhead 10 from one location to another within the pool (for example, because of a specific distance requirement in a swimming race), the bulkhead is first unlocked through removal of the pins 26. Subsequently, air is injected into the interior of the chambers 16 through the valves 18, as shown in FIG. 3A. As the air pressure within the compartment increases, water is forced out of the chamber and into the pool through apertures 20. This, in turn, causes the bulkhead to become more buoyant, releasing it from frictional contact with the side channel of the pool and allowing it to be shifted to the next desired position, as in FIG. 3B. When the bulkhead is in the new position, as shown in FIG. 3C, air within the chambers 16 is allowed to exit through the valves 18, thereby allowing water to reenter the interior of chamber 16 through apertures 20. As the level of water within the chambers increases, the buoyancy necessary for movement of the bulkhead is lost, allowing the bulkhead to submerge and come to rest on the side channels of the pool. The bulkhead may then be secured through the attachment of the pins 26 to appropriate receptors on the side channel of the pool.

As best shown in FIG. 1, the bulkhead may also be provided with a series of laterally extending slots 30 in its side walls which act to dampen the wave action of the water. In addition, the top surface of the bulkhead should preferably be of a textured, nonskid surface as a safety consideration. It is also preferable to avoid the use of any rough edges, angles, or openings that may hold or injure in any way the individuals using a pool into which this movable bulkhead is placed. The bulkhead may be constructed to any variety of design specifications, including various colors and racing lane target configurations.

From the foregoing, it will be appreciated that, although specific embodiments of the invention have been described herein for purposes of illustration, various modifications may be made without departing from the spirit and scope of the invention. Accordingly, the invention is not limited except as by the appended claims.

I claim:

1. A movable, submersible, elongated bulkhead for use in a swimming pool, comprising:

a pair of spaced air chambers each having an outwardly facing end, said chambers provided with a valve communicating with the interior of said air chambers for passing air into and out of the chambers and with a water inlet;

at least one core of buoyant material positioned between and substantially equidistant from each of said air chambers;

a pair of compartments positioned adjacent to the outwardly facing ends of said air chambers, each of said compartments having an opening providing for the free ingress and egress of water into and out of said compartment; and means for selectively controlling the quantity of air and water within said chambers by passing air through said valve to displace water within the chambers.

2. The bulkhead as defined in claim 1, including means for guiding said bulkhead while in transit.

3. The bulkhead as defined in claim 2 wherein said guide means includes a set of plastic bumper strips covering the bulkhead at the area of frictional contact between the bulkhead and the pool.

4. The bulkhead as defined in claim 1, including means for locking said bulkhead to the pool to maintain the bulkhead in a stationary position.

5. The bulkhead as defined in claim 4 wherein said locking means includes a set of noncorrosive bolts positioned to securely attach the bulkhead to the pool.

6. The bulkhead as defined in claim 1, including a series of laterally extending slots positioned at the water line of said bulkhead for dampening the wave action of the water within the pool.

7. The bulkhead as defined in claim 1 wherein said means for selectively controlling includes a source of gas under pressure communicating with said valves, and said water inlet includes at least one aperture freely communicating with both the interior of the chamber and the water in the pool.

8. The bulkhead as defined in claim 1 wherein said core of buoyant material is foam or entrapped air.

9. A movable, submersible, transversely extending bulkhead for use in a swimming pool, comprising:

an elongated hollow body having opposite ends and top, bottom, end and side walls, said body having at least one air chamber positioned towards each of the ends of the body, said chambers having separate air and water inlets, and means for selectively controlling the quantity of air and water within said chambers for regulating the buoyancy of the bulkhead.

10. The bulkhead as defined in claim 9, including means for locking said bulkhead to the pool to maintain the bulkhead in a stationary position.

11. A method of moving along the length of a swimming pool a transversely extending bulkhead adapted to rest on a surface of the pool, said bulkhead having at least one air chamber positioned towards each end of said bulkhead, and means for selectively controlling the quantity of air and water within said chambers, comprising the steps of:

increasing the buoyancy of said bulkhead by forcibly displacing the water contained in said chambers initially while the bulkhead is resting on the surface of the pool;

shifting the bulkhead to a new spaced position within the pool; and decreasing the buoyancy of said bulkhead to again rest the bulkhead on a surface of the pool by having water reenter said chambers.

12. The method as defined in claim 11 wherein buoyancy is increased in said chambers by increasing the air pressure within the chamber, thereby displacing water within the chamber through apertures in communication therewith.

13. The method as defined in claim 11, including unlocking the bulkhead from the pool prior to increasing the buoyancy, and locking the bulkhead to the pool subsequent to decreasing the buoyancy.

14. The method as defined in claim 12 wherein air pressure is increased within said chamber by injecting air through a valve positioned thereon.

* * * * *